US006986490B2

(12) United States Patent
Eihusen et al.

(10) Patent No.: US 6,986,490 B2
(45) Date of Patent: Jan. 17, 2006

(54) METHOD AND APPARATUS FOR MOUNTING A FLUID CONTAINMENT CYLINDER

(75) Inventors: John A. Eihusen, Lincoln, NE (US); Norman L. Newhouse, Lincoln, NE (US)

(73) Assignee: Hexagon Technology AS, Ålesund (NO)

( * ) Notice: Subject to any disclaimer, the term of this patent is extended or adjusted under 35 U.S.C. 154(b) by 0 days.

(21) Appl. No.: 10/461,886

(22) Filed: Jun. 13, 2003

(65) Prior Publication Data

US 2004/0056164 A1 Mar. 25, 2004

Related U.S. Application Data

(60) Provisional application No. 60/388,911, filed on Jun. 14, 2002.

(51) Int. Cl.
*A47K 1/08* (2006.01)

(52) U.S. Cl. ..... 248/312; 248/154

(58) Field of Classification Search ..... 248/312, 248/312.1, 154, 230.9, 544, 671, 674, 313; 220/1.5, 581, 562, DIG. 4
See application file for complete search history.

(56) References Cited

U.S. PATENT DOCUMENTS

| | | | | |
|---|---|---|---|---|
| 2,380,562 | A | 7/1945 | Watson, Jr. | |
| 3,653,624 | A | 4/1972 | Abel | |
| 3,700,200 | A | 10/1972 | Batchelor et al. | |
| 4,555,083 | A * | 11/1985 | Carter | 248/313 |
| 5,035,084 | A * | 7/1991 | Towns | 49/381 |
| 5,515,997 | A | 5/1996 | Kirk et al. | |
| 2003/0006349 | A1 * | 1/2003 | Sadowski et al. | 248/154 |
| 2004/0075034 | A1 * | 4/2004 | Yokote | 248/312 |

* cited by examiner

*Primary Examiner*—Ramon O Ramirez
(74) *Attorney, Agent, or Firm*—Kinney & Lange, P.A.

(57) ABSTRACT

Structures for securing a fluid containment cylinder at the neck portion of the cylinder include a mounting frame having a bore disposed therein and a slot disposed orthogonally to the central axis of the bore. The neck of the cylinder passes through the bore and a u-bolt passes through the slot, registering against a shoulder on the neck of the cylinder, thereby securing the cylinder within the block. In other embodiments, the securing structure includes a collar for preventing rotation of the cylinder or for accommodating a certain degree of misalignment of the cylinder with respect to the securement structure.

21 Claims, 10 Drawing Sheets

METHOD AND APPARATUS FOR MOUNTING A FLUID CONTAINMENT CYLINDER

This application claims priority to U.S. Provisional Patent Application Ser. No. 60/388,911, filed Jun. 14, 2002.

BACKGROUND OF THE INVENTION

The present invention relates generally to fluid storage, and specifically to a method and apparatus for mounting a fluid containment vessel.

In many applications, the qualities of lightweight construction and high resistance to fragmentation and corrosion damage are highly desirable characteristics for a pressure vessel. These design criteria have been met for many years by the development of high pressure composite (fiber reinforced resin matrix) containers; for instance, containers fabricated of laminated layers of wound fiberglass filaments or various types of other synthetic filaments which are bonded together by a thermal-setting or thermoplastic resin. An elastomeric or other non-metal resilient liner or bladder often is disposed within the composite shell to seal the vessel and prevent internal fluids from contacting the composite material.

Such composite vessels have become commonly used for containing a variety of fluids under pressure, such as storing oxygen, natural gas, nitrogen, rocket or other fuel, propane, etc. The composite construction of the vessels provides numerous advantages such as lightness in weight and resistance to corrosion, fatigue and catastrophic failure. These attributes are due to the high specific strengths of the reinforcing fibers or filaments that typically are oriented in the direction of the principal forces in the construction of the pressure vessels.

Composite pressure vessels of the character described above originally were developed for aircraft and aerospace applications primarily because of the critical weight restrictions in such vehicles. As compressed natural gas (CNG) has become more widely used in ground-based vehicles such as buses and cars, however, the composite pressure vessel has become more widely used in such vehicles as well.

The structural requirements of a pressure vessel are such that a generally-cylindrical shape having rounded ends is a highly-desirable form factor from a standpoint of both strength and packing efficiency. Unfortunately, the rounded shape can make securing such a pressure vessel to the vehicle difficult.

The neck of the compressed gas cylinder provides a structural protrusion suitable for attachment by a collar or similar device. Certain known designs make use of this feature to secure a gas cylinder. Unfortunately, such designs suffer from a number of drawbacks. Certain designs handle misalignment poorly, and can place substantial stresses on the neck structure in the event of misalignment. Certain designs inadequately secure the neck, so that there is an unacceptable risk that the cylinder might work itself free under the right conditions. Finally, certain designs are such that the cylinder can rotate about the principal axis of the cylinder, thereby placing stress on the connection lines or other attached hardware.

SUMMARY OF THE INVENTION

The vessel securement method and apparatus disclosed herein provides a unique combination of structures suitable for safely securing a pressure vessel under a variety of conditions. Using the teachings of the present invention, one of skill in the art will be able to readily construct a pressure vessel mounting scheme suitable for securely fastening a pressure vessel against axial and rotational movement. Further, the teachings of the present invention are suitable for construction of pressure vessel mounting structures able to accommodate a substantial degree of misalignment without unduly stressing the neck of the pressure vessel.

In one embodiment, the present invention includes a compressed gas cylinder mount incorporating a frame having a top surface, a front surface, a back surface, a neck receiving bore passing through the frame from the front surface to the back surface, and a fastener bore passing through the frame from the top surface to the neck receiving bore. A fastener is disposed within the fastener bore, having a neck receiving end and a threaded end. The neck receiving end has an inner profile suitable for capturing the neck of a compressed gas cylinder. A nut, threadably engaged to the threaded end of the fastener, is used to tighten and secure the assembly.

In a second embodiment, the invention includes a frame having a neck receiving bore passing through the frame from its front surface to its back surface. The frame has a pair of fastener bores passing through the frame on either side of the neck receiving bore from the bottom surface to the top surface. The neck of the cylinder is secured by a u-bolt, having a neck receiving end and first and second threaded uprights, with each threaded upright disposed within one of the first and second fastener bores. A pair of nuts secure the assembly.

In a third embodiment, the invention includes a frame having a neck receiving bore passing through the frame from its front surface to its back surface and a fastener bore passing through the frame from its top surface to the neck receiving bore. A fastener is disposed within the fastener bore, having a neck receiving end and a threaded end. The neck receiving end has an inner profile suitable for capturing the neck of a compressed gas cylinder. A nut, threadably engaged to the threaded end of the fastener, secures the assembly.

In this embodiment, the rotational orientation of the cylinder is fixed using a locating collar disposed on the front surface of the frame around the neck receiving bore. The collar has a first locator receiving feature and a second locator receiving feature. A first locator, disposed in the front surface of the frame, is mated to the first locator receiving feature. A second locator is disposed within the second locator receiving feature and a neck locating feature.

In a fourth embodiment, the present invention includes a frame having a neck receiving bore passing through the frame from the front surface to the back surface and a spherical inner surface disposed around the neck receiving bore. A spherical bearing, having a spherical outer surface and a cylindrical inner surface, is disposed at least partly within the spherical inner surface of the frame. A retainer, having a spherical inner surface, is disposed against the spherical bearing opposite the mount and secured to the mount, thereby capturing the spherical bearing.

BRIEF DESCRIPTION OF THE DRAWINGS

For more complete understanding of the features and advantages of the present invention, reference is now made to the detailed description of the invention along with the accompanying figures, in which.

DETAILED DESCRIPTION OF THE INVENTION

Figure 1:
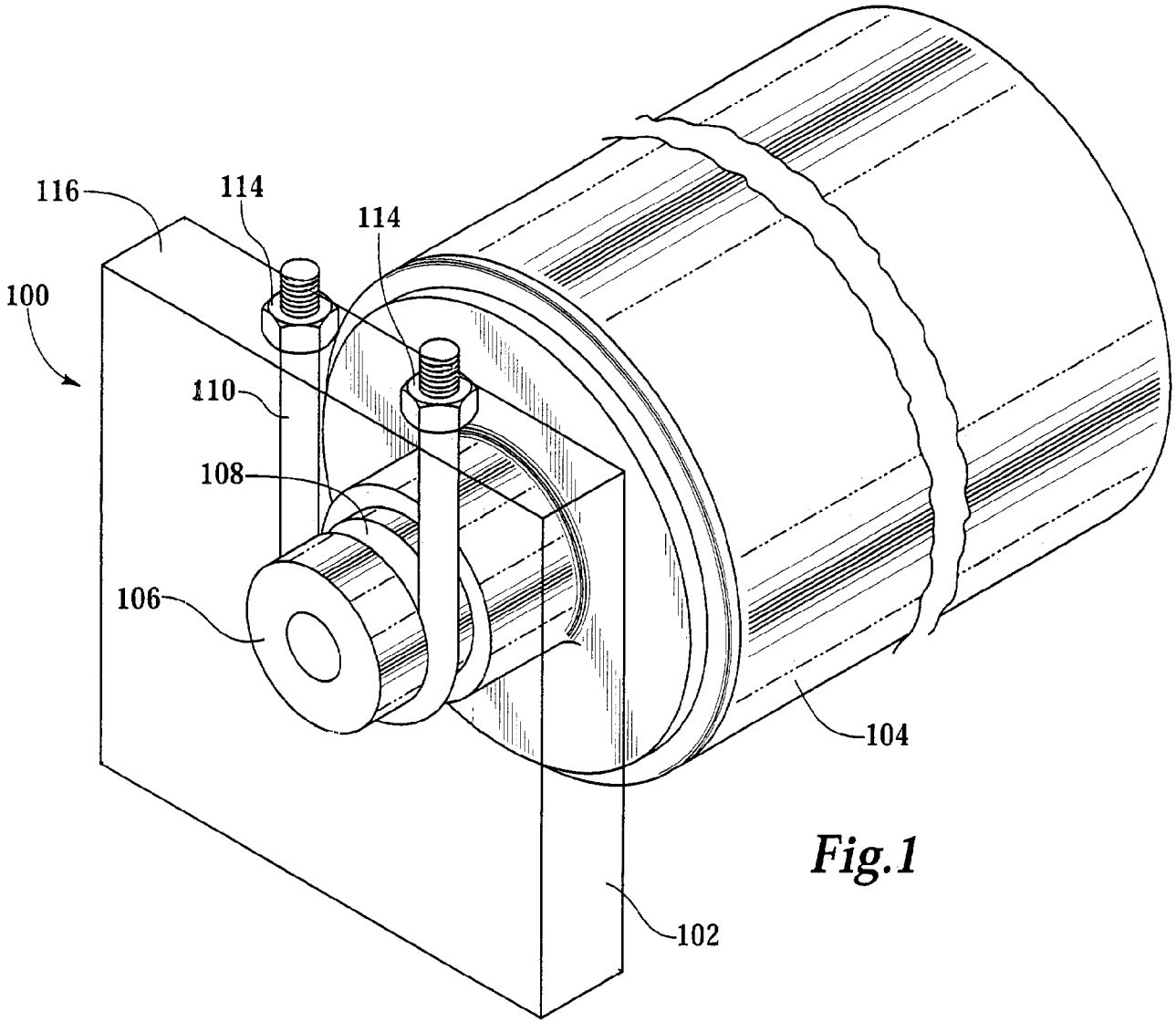
FIG. 1 depicts an isometric view of a compressed gas cylinder and mount assembly according to one embodiment of the present invention.
Figure 2:
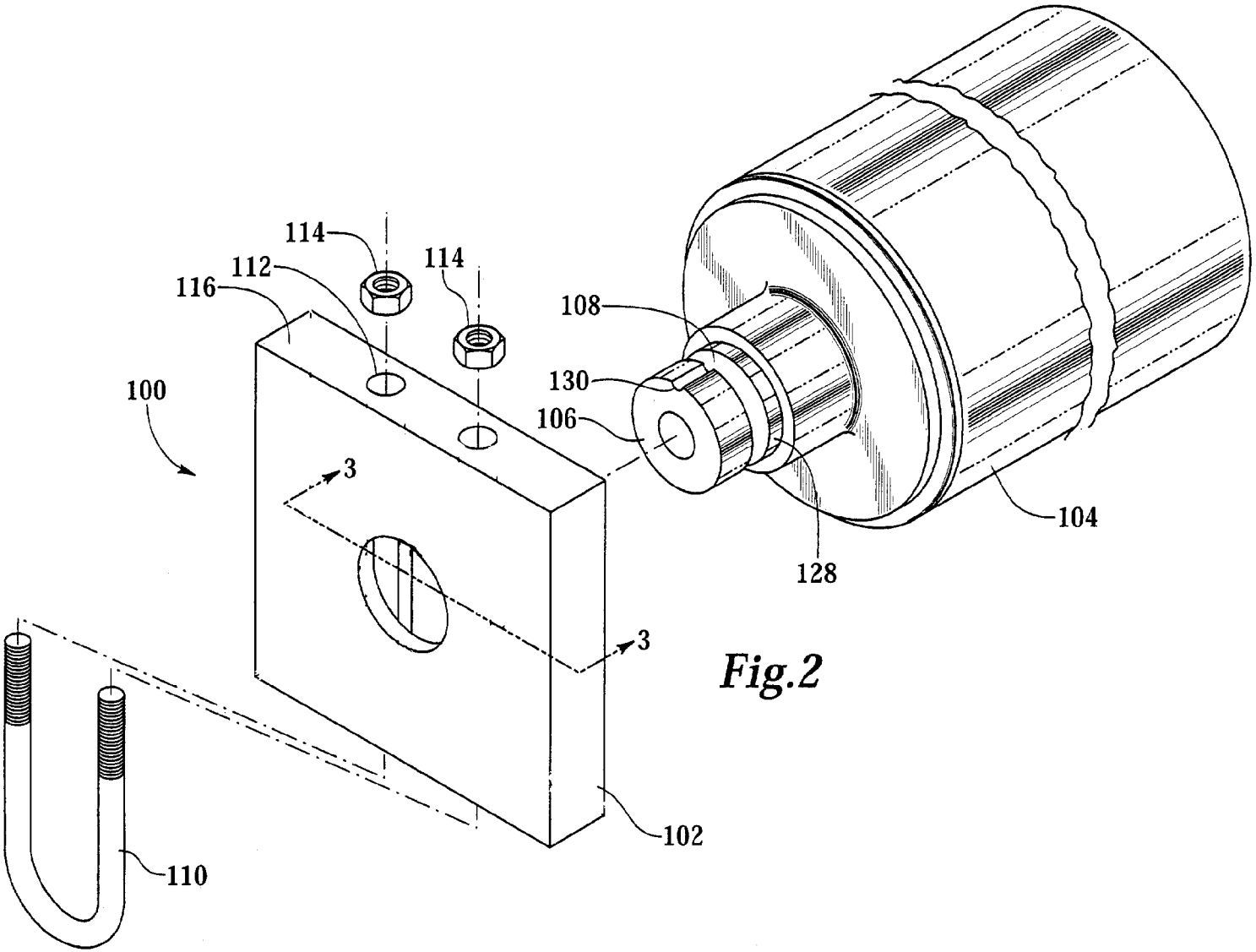
FIG. 2 depicts an exploded isometric view of the compressed gas cylinder and mount assembly of FIG. 1.
Figure 3:
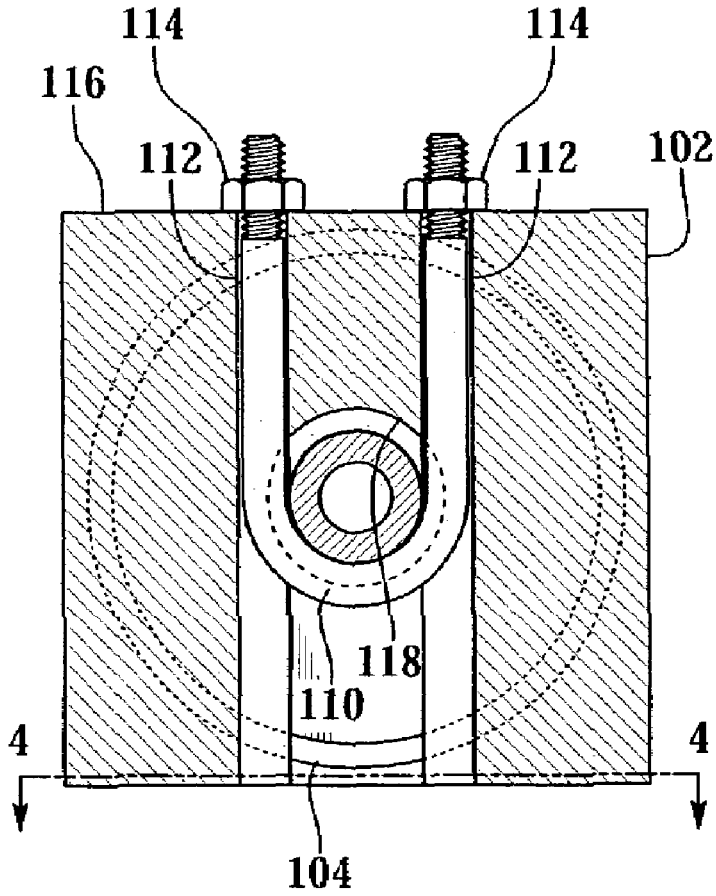
FIG. 3 depicts a front section view of the compressed gas cylinder and mount assembly of FIGS. 1 and 2 taken along line 3—3 of FIG. 2.
Figure 4:
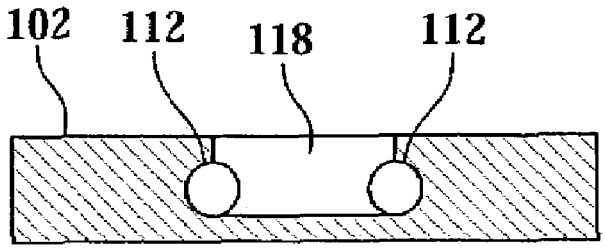
FIG. 4 depicts a bottom section view of a cylinder frame according to certain embodiments of the present invention.

While the making and using of various embodiments of the present invention are discussed in detail below, it should be appreciated that the present invention provides many applicable inventive concepts that may be embodied in a wide variety of specific contexts. The specific embodiments discussed herein are merely illustrative of specific ways to make and use the invention and do not delimit the scope of the invention. Various modifications and combinations of the illustrative embodiments, as well as other embodiments of the invention, will be apparent to persons skilled in the art upon reference to the description. It is therefore intended that the appended claims encompass any such modifications or embodiments.

As seen in FIGS. 1–4, cylinder and mount assembly 100 includes a rigid frame 102 designed to receive a cylinder 104 by the neck 106 of cylinder 104. In this embodiment, the frame 102 captures neck 106 and fixes it in its axial position by registering against an annular groove 108 in the neck 106. The securement is accomplished by a fastener 110, which may be a u-bolt, as shown in FIGS. 1–4. Those of skill in the art will have knowledge of other suitable fasteners. As examples, a j-bolt, an eye-bolt, or a square bend u-bolt could be used in place of the u-bolt shown in FIGS. 1–4 without departing from the spirit and scope of the present invention. The fastener 110 could be a plate or subframe, or even a band or strap. As noted, these fastening solutions, and many others, will be known to those of skill in the art.

In the embodiment shown in FIGS. 1–4, the fastener 110 is held in place by one or more nuts 114 threadably engaged to one or more threaded portions of fastener 110. As with the type of fastener 110 employed, although a threaded fastener may be preferred for certain embodiments, there is nothing within the spirit and scope of the present invention limiting the fastener 110 to threaded fasteners. Locking pins, elastomeric materials, or friction-based securement mechanisms could be employed. The securement mechanism could make use of plastic deformation of the fastener, or even welding or adhesive bonding of the fastener 110 to the frame 102, particularly in applications wherein the cylinder 102 is installed permanently. Each of these mechanisms, and many others, are within the spirit and scope of the present invention, as will be appreciated by those of skill in the art. In many applications, it will be necessary that the fastener 110 incorporate some form of tensioning mechanism similar to the operation of the nuts 114 on the threads of the u-bolt in order to solidly secure the neck 106 of the tank 104.

The design of frame 102 may vary from one application to another. In the embodiment shown in FIGS. 1–4, the frame 102 has a generally box-like shape, having front, back, top, bottom, and side surfaces. Other shapes will be suitable, depending on application. Frame 102 of FIGS. 1–4 receives neck 106 of cylinder 104 through neck receiving bore 118.

The fastener 110 passes through fastener bores 112 to the top surface 116 of the frame 102. As the fastener 110 is tightened against the neck 106 using nuts 114, the upper surface of the neck 106 is forced against the upper surface of neck receiving bore 118, thereby securing cylinder 104.

Figure 5:
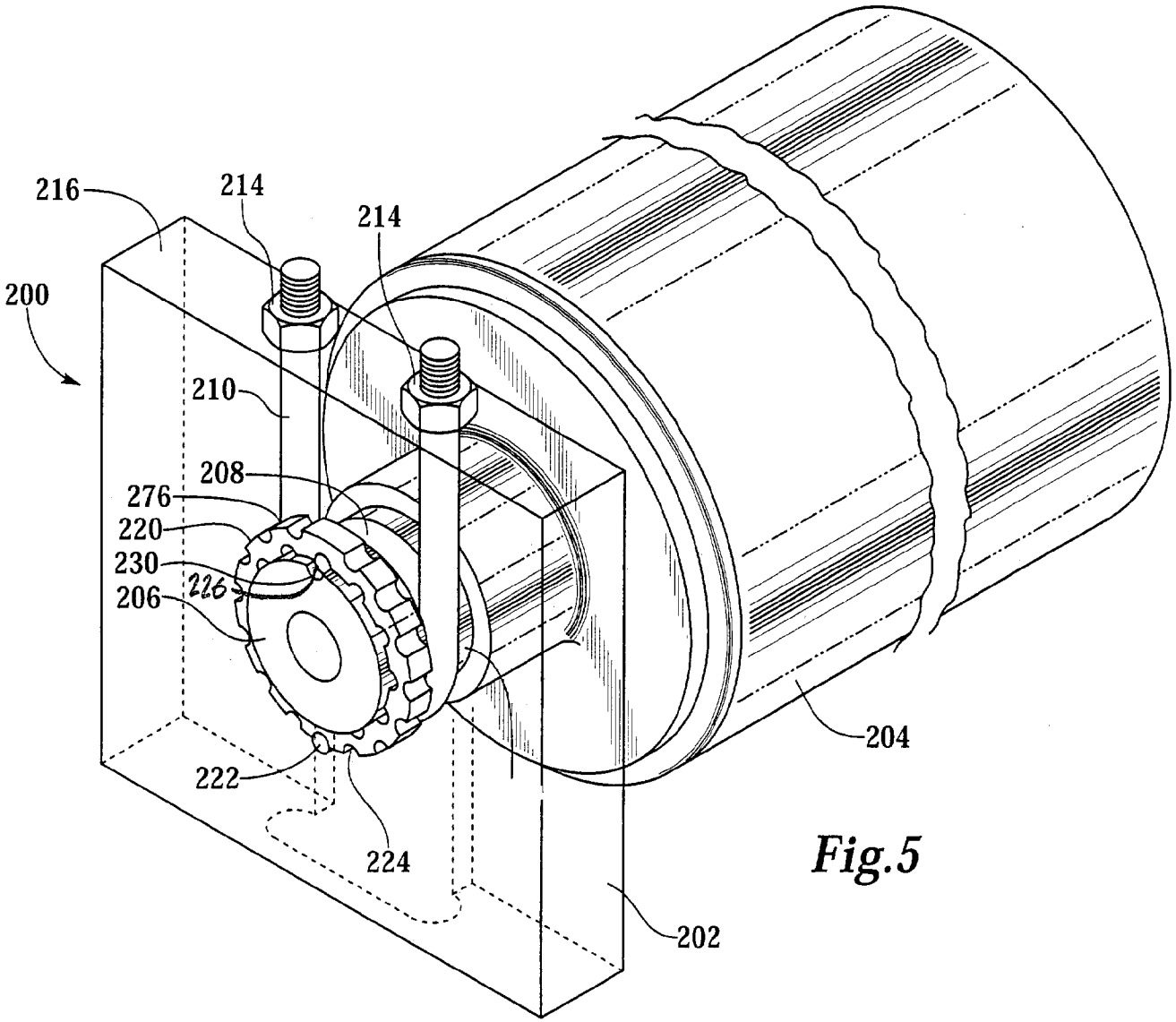
FIG. 5 depicts an isometric view of a compressed gas cylinder and mount assembly according to a second embodiment of the present invention.
Figure 6:
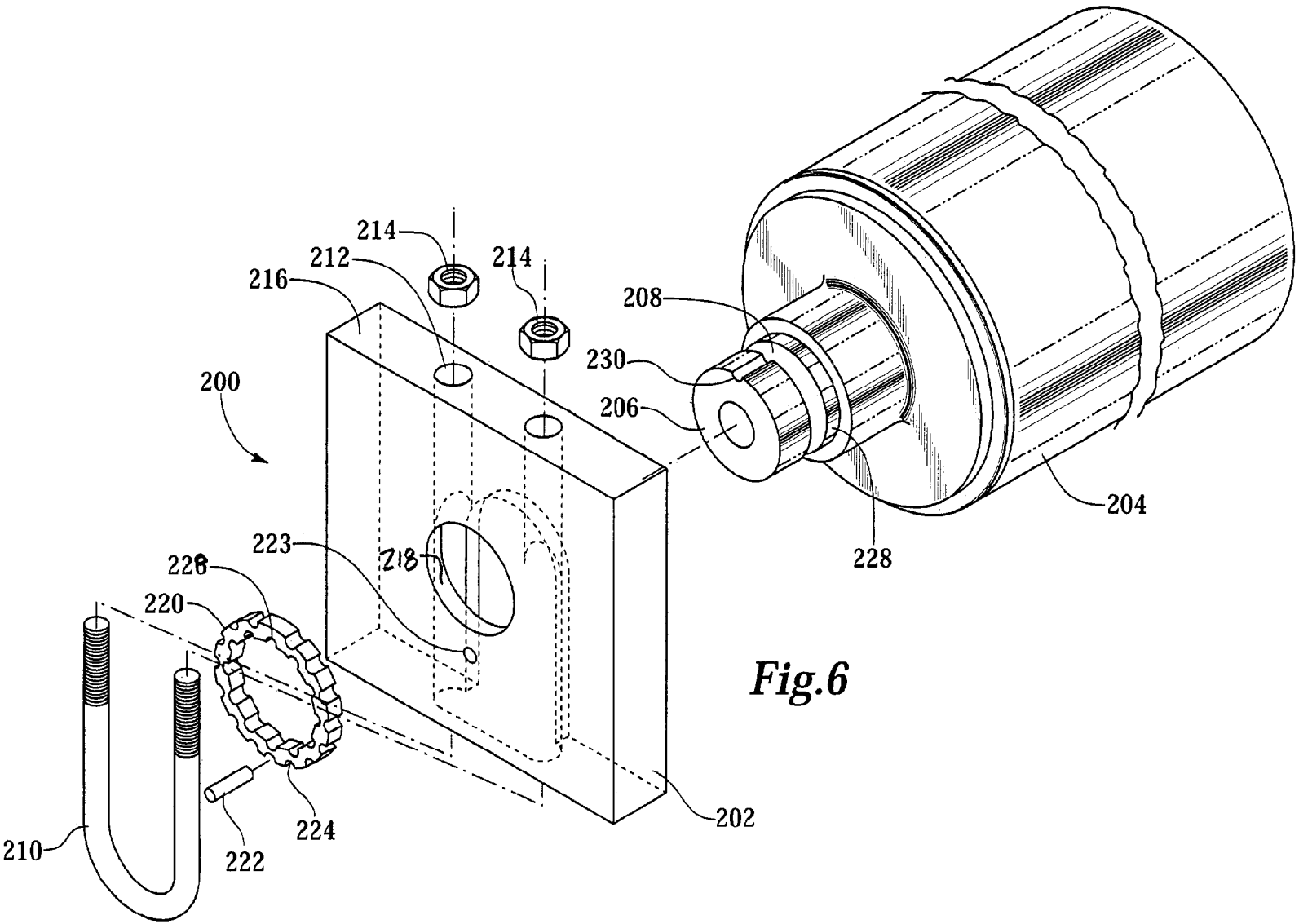
FIG. 6 depicts an exploded isometric view of the compressed gas cylinder of FIG. 5.

FIG. 5 depicts an isometric view of a compressed gas cylinder and mount assembly according to a second embodiment of the present invention. FIG. 6 depicts an exploded isometric view of the assembly of FIG. 5. As seen in FIGS. 5 and 6, cylinder and mount assembly 200 includes a rigid frame 202 designed to receive a cylinder 204 by the neck 206 of cylinder 204. In this embodiment, the frame 202 captures neck 206 and fixes it in its axial position by registering against an annular groove 208 in the neck 206. The securement is accomplished by a fastener 210, which may be a u-bolt, as shown in FIG. 5. Those of skill in the art will have knowledge of other suitable fasteners, including but not limited to the fasteners specifically described above in connection with fastener 110. In this embodiment, the fastener 210 is held in place by one or more nuts 214 threadably engaged to one or more threaded portions of fastener 210. As with fastener 110, there is nothing within the spirit and scope of the present invention requiring that fastener 210 be a threaded fastener.

The design of frame 202 may vary from one application to another. In the embodiment shown in FIGS. 5 and 6, the frame 202 has a generally box-like shape, having front, back, top, bottom, and side surfaces. Other shapes will be suitable, depending on application. Frame 202 of FIG. 5 receives neck 206 of cylinder 204 through neck receiving bore 218.

The fastener 210 passes through fastener bores 212 to the top surface 216 of the frame 202. As the fastener 210 is tightened against the neck 206 using nuts 214, the upper surface of the neck 206 is forced against the upper surface of neck receiving bore 218, thereby securing cylinder 204.

In addition to the mounting structures described above in connection with FIGS. 5 and 6, which are largely identical to the structures described above in connection with FIGS. 1–4, assembly 200 incorporates additional structures for securing cylinder 204 in its rotational orientation. Specifically, assembly 200 incorporates a location collar 220 designed to fix the rotational orientation of the neck 206 to that of the frame 202.

In operation, the location collar 220 is disposed about the neck 206 and fixed in its rotational orientation by first locator 222 registering against one of the location grooves 224 in the location collar 220 as well as a locating feature in the frame 202. In the embodiment depicted in FIG. 5, the first locator 222 is a pin disposed within a pin bore 223 in the frame 202, but those of skill in the art will appreciate that a wide variety of structures and mechanisms may be suitable for this purpose.

With the rotational orientation of the location collar 220 fixed by the first locator 222, the rotational orientation of the neck 206, and therefore the tank 204, can be fixed by locating the neck 206 to the location collar 220. This task is accomplished by second locator 226, which locates the neck 206 using one of collar-to-neck location grooves 228 and neck axial groove 230 in the neck 206 of the tank 204.

In the embodiment shown in FIGS. 5 and 6, the second locator 226 is a pin, but those of skill in the art will recognize that a number of structures are suitable for use in this application. Further, although the locating features shown in FIGS. 5 and 6 are grooves 224, 228 and 230, those of skill in the art will appreciate that locating holes would work in a similar manner, particularly with respect to collar locating grooves 224.

In certain embodiments, the spacing of the locating grooves 224 and 228 are such that the orientation of the cylinder 204 can be adjusted with a relatively high degree of precision even with a relatively small number of locating grooves. In one embodiment, the pattern of inner and outer grooves 224 and 228 is such that the cylinder 204 can be fixed in place at any point around a 360-degree angle to a precision of one degree.

Figure 7:
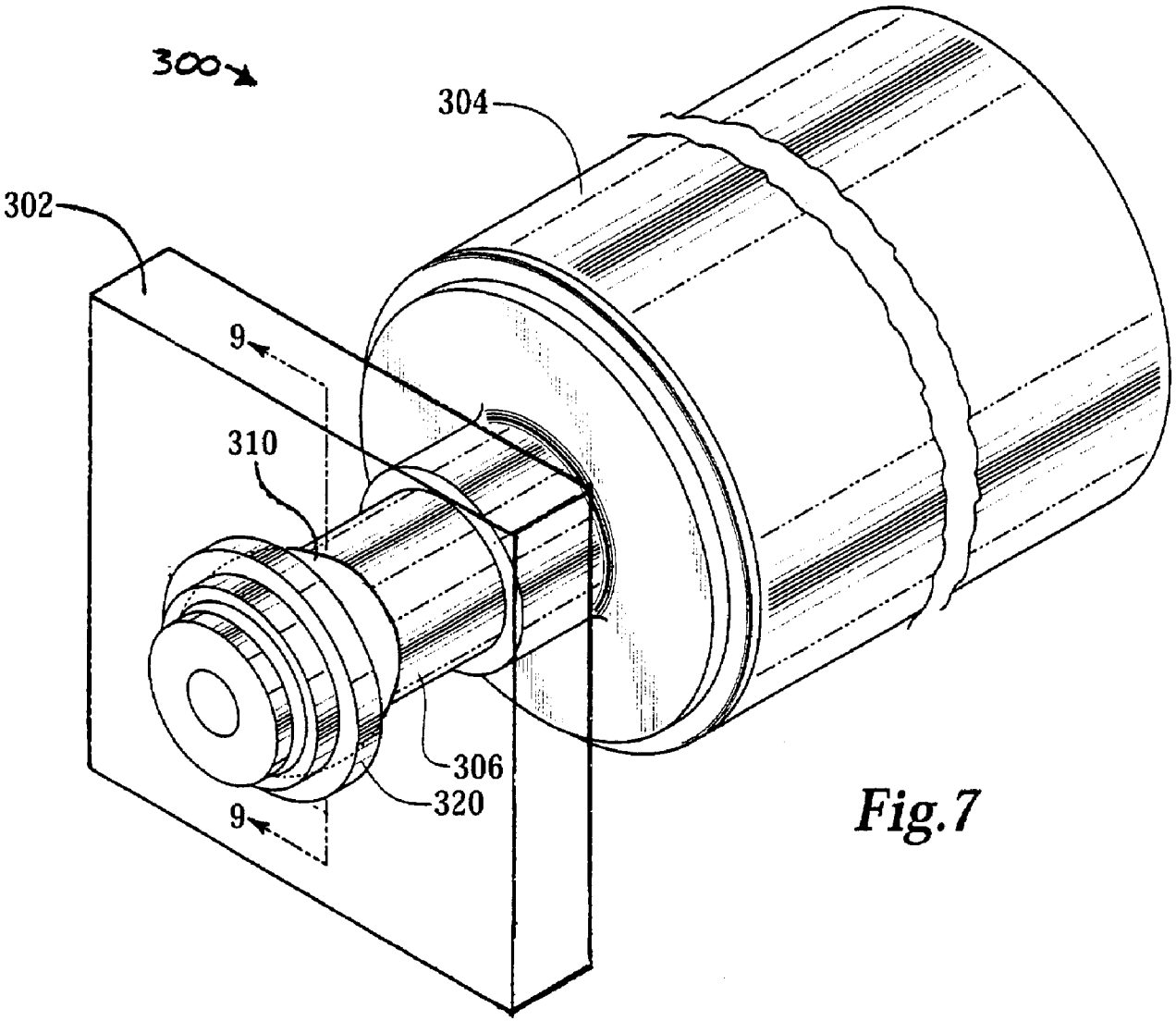
FIG. 7 depicts an isometric view of a compressed gas cylinder and mount assembly according to a third embodiment of the present invention.
Figure 8:
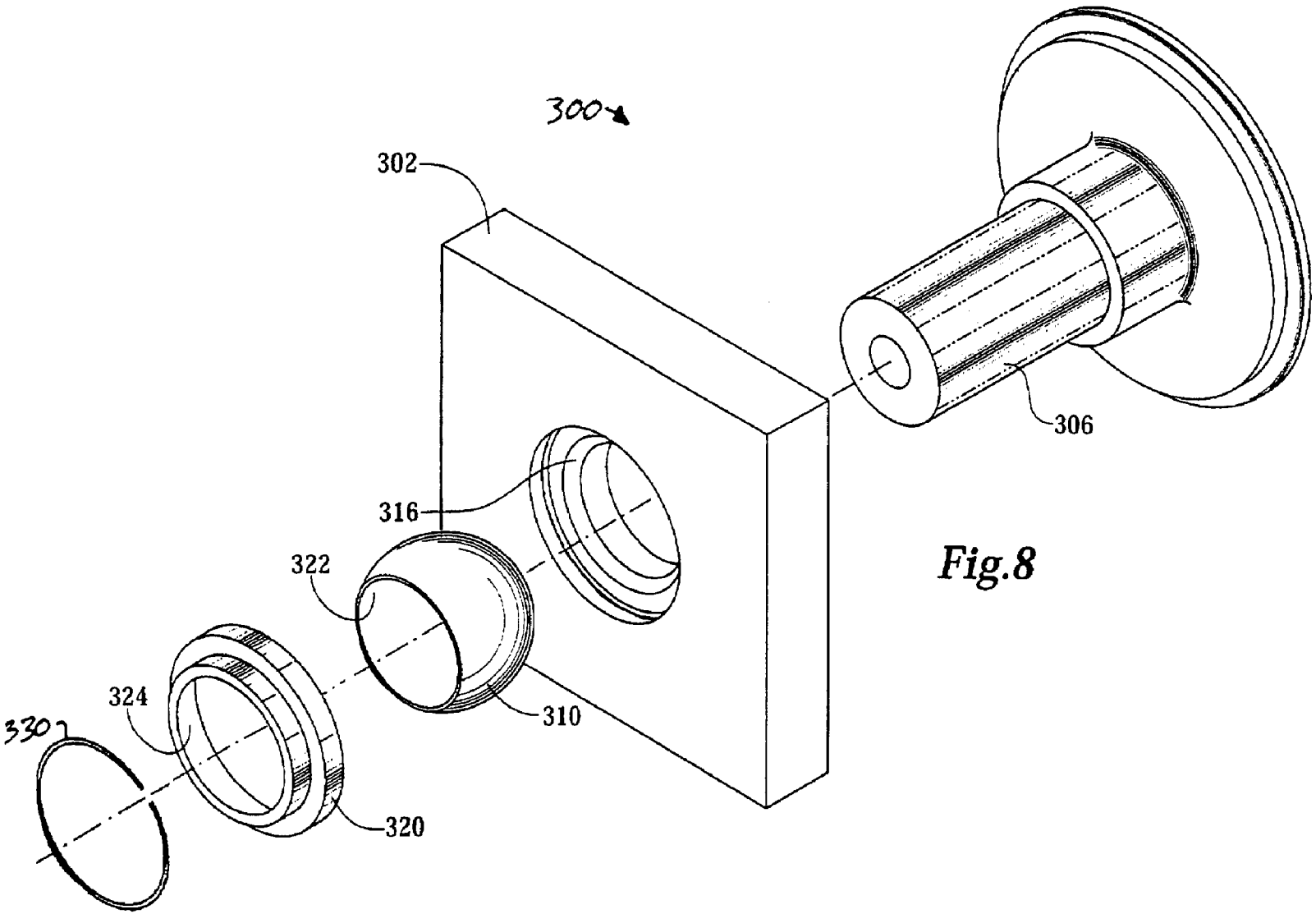
FIG. 8 depicts an exploded isometric view of the assembly of FIG. 7.
Figure 9:
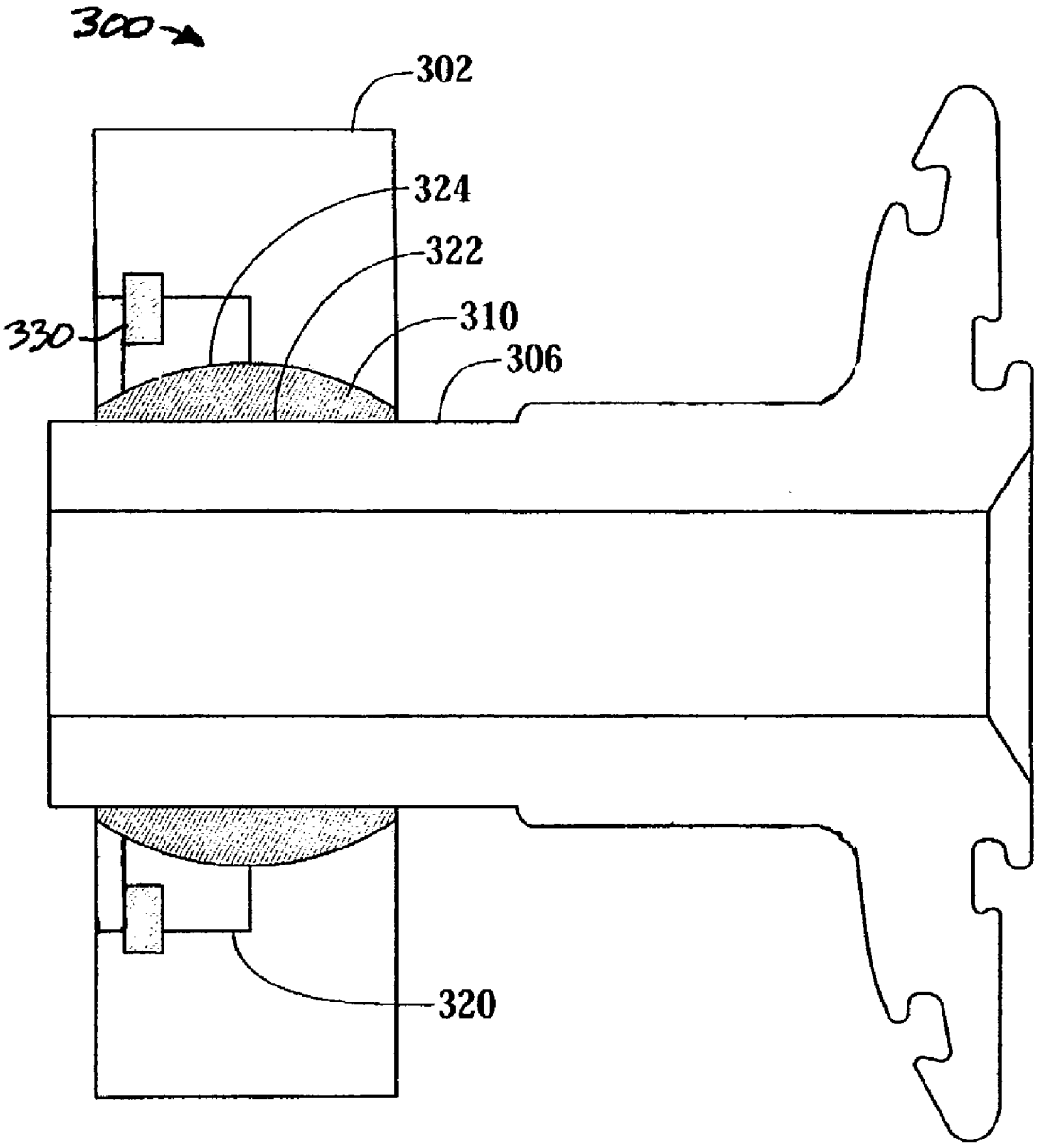
FIG. 9 depicts a side section view of the assembly of FIGS. 7 and 8 taken along line 9—9 of FIG. 7.

Cylinder and frame assembly 300, shown in FIGS. 7–9, differs from the embodiments shown in FIGS. 1–4 in the use of a spherical bearing 310 in place of the fastener 110 shown and described in those figures. Spherical bearing 310 is disposed around the outer surface of neck 306. The inner surface 322 of spherical bearing is shaped to mate with the outer surface of the neck 306. In the embodiment shown in FIGS. 7, 8 and 9, the inner surface 322 is cylindrical, in order to conform to the cylindrical shape of the neck 306. Depending on application, spherical bearing 310 may be either fixed or slidable on neck 306. A slidable design would have the advantage of providing the highest degree of compliance to misalignment, while a fixed design would have the advantage of holding the cylinder more securely. As assembled, spherical bearing 310 seats against a spherical inner surface 316 in the frame 302. The spherical bearing 310 is captured within frame 302 by securing collar 320. Securing collar 320 may have a spherical inner surface 324 shaped to seat with the outer surface of spherical bearing 310. Securing collar 320 may be retained within frame 302 by a number of methods. In the embodiment shown in FIGS. 7–9, securing collar is retained by snap ring 330, but other methods of securement, including but not limited to a threaded engagement, may be employed.

Using this arrangement, a certain degree of axial misalignment can be tolerated by the assembly without placing potentially harmful stresses on the neck 306 of the cylinder 304. In certain embodiments, assembly 300 may incorporate one or more features similar to locating collar 220, described above, to fix the rotational location of the cylinder 304 while still allowing for a certain degree of misalignment.

Figure 10:
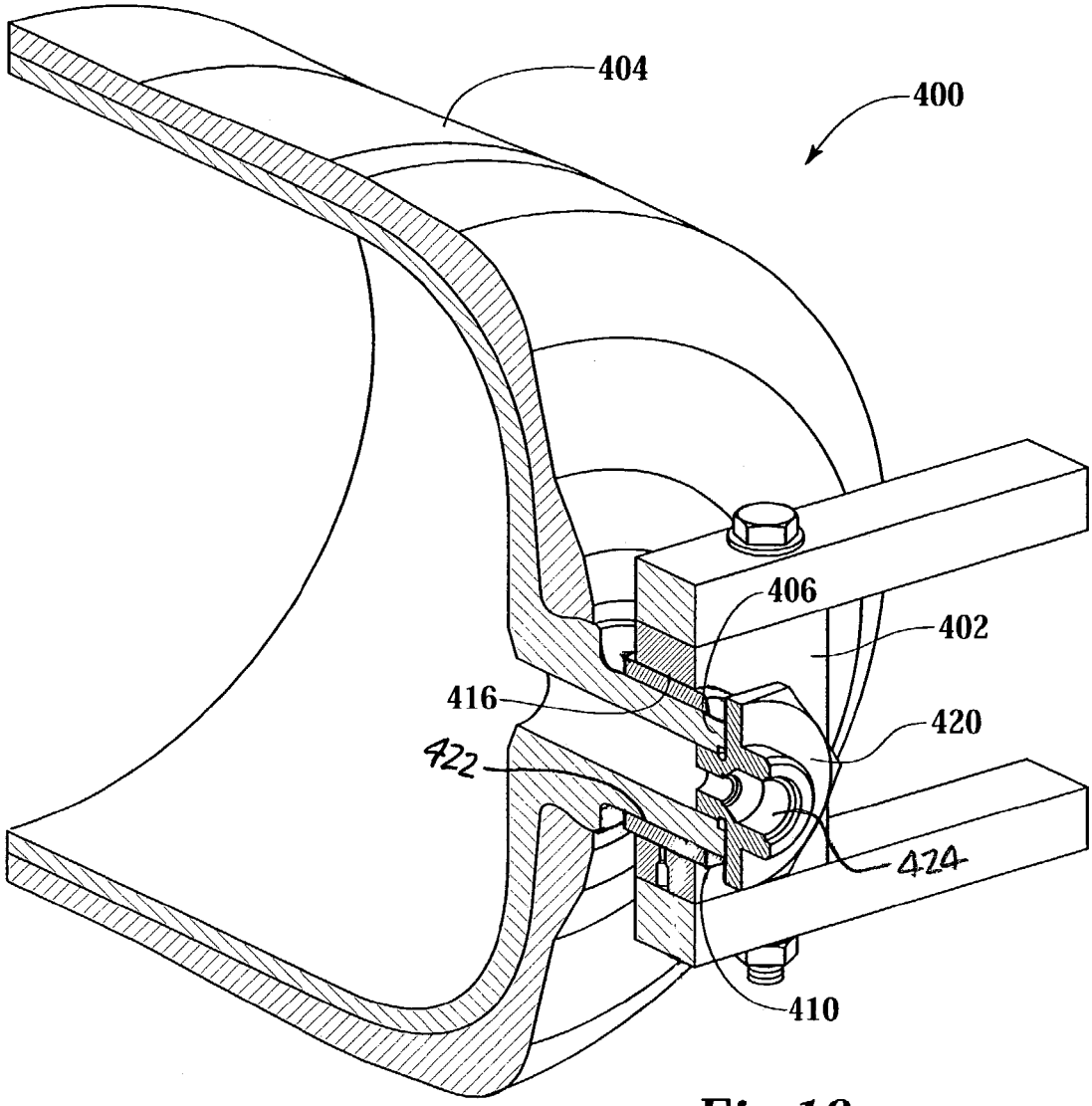
FIG. 10 depicts a section isometric view of a compressed gas cylinder and mount assembly according to a fourth embodiment of the present invention.

FIG. 10 depicts an isometric sectional view of a compressed gas cylinder and mount assembly 400 according to a fourth embodiment of the present invention. Cylinder and frame assembly 400 makes use of a cylindrical bearing 410. Cylindrical bearing 410 is disposed around the outer surface of neck 406. The inner surface 422 of cylindrical bearing 410 is shaped and sized to mate with the outer surface of the neck 406.

In the embodiment shown in FIG. 10, the inner surface 422 is cylindrical, in order to conform to the cylindrical shape of the neck 406. Cylindrical bearing 410 is slidable on neck 406. As assembled, cylindrical bearing 410 seats against a cylindrical inner surface 416 in the frame 402. Similarly, neck 406 has a certain degree of freedom of movement in axial displacement within cylindrical bearing 410, with such axial displacement being bounded on the one end by the shoulder on 422 and at the other end by securement plug 420. With this arrangement, the cylindrical bearing 410 is captured within frame 402 by securement plug 420, but is otherwise free to slide axially within frame 402. Similarly, neck 406 has a certain degree of freedom of movement in axial displacement within cylindrical bearing 410, with such axial displacement being bounded on the one end by the shoulder on 422 and at the other end by securement plug 420. Depending on the specific application, securement plug 420 may be secured to neck 406 by a variety of structures, including a threaded connection, a snap fit, a press fit or any other method known to those of skill in the art. In the embodiment shown in FIG. 10, securement plug 420 incorporates a fill port 424 for filling and evacuation of gas cylinder 404.

Those of skill in the art will appreciate that, although this design allows for a substantial degree of axial translation, it allows for only a very limited degree of axial misalignment. Where axial alignment is a concern, the incorporation of a spherical bearing may be advisable. In certain embodiments, assembly 400 may also incorporate one or more features similar to locating collar 220, described above, to fix the rotational location of the cylinder 404 while still allowing for a certain degree of misalignment.

Figure 11:
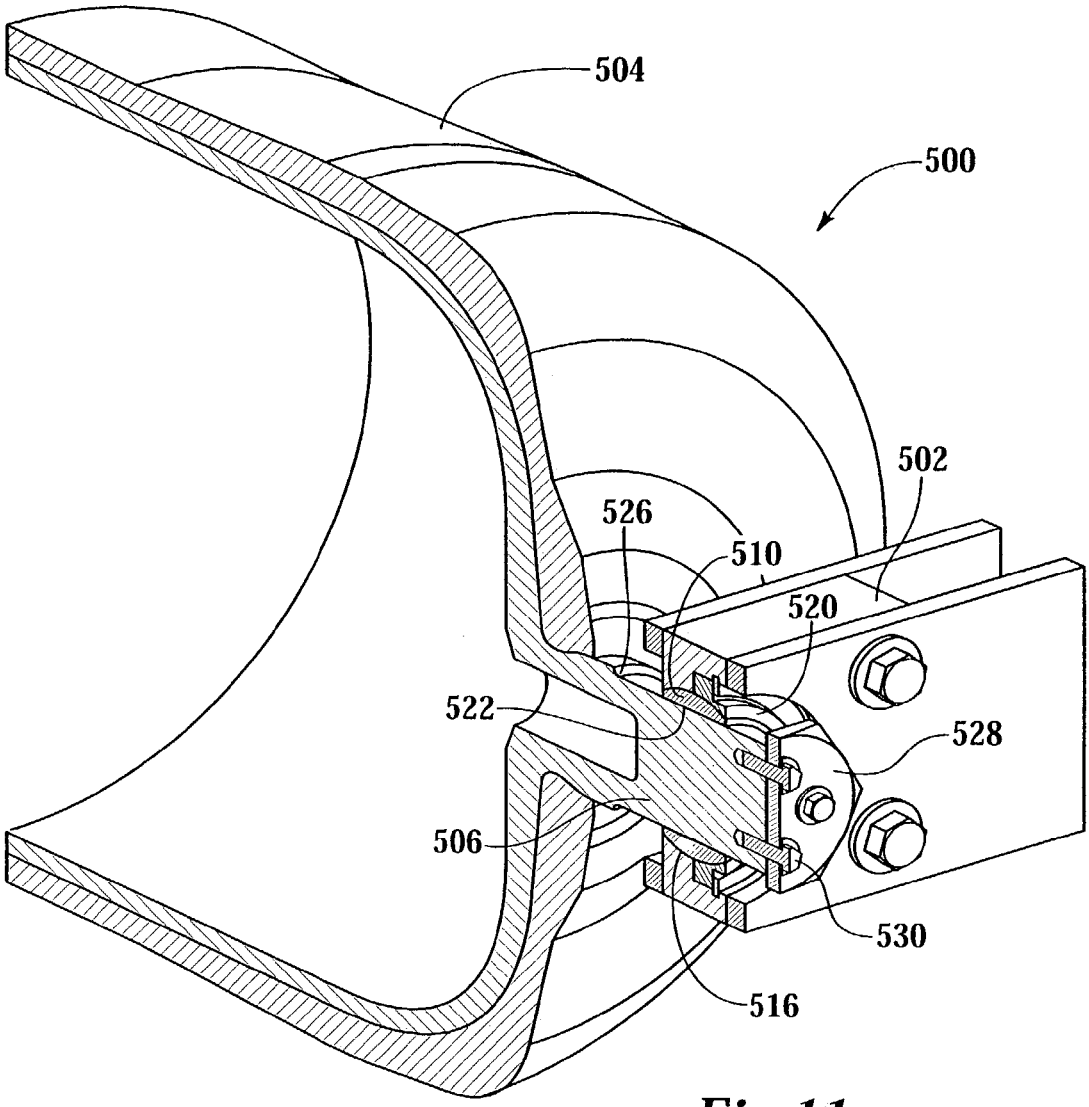
FIG. 11 depicts a section isometric view of a compressed gas cylinder and mount assembly according to a fifth embodiment of the present invention.

Cylinder and frame assembly 500, depicted in FIG. 11, makes use of a combination spherical/cylindrical bearing 510. Spherical/cylindrical bearing 510 is disposed around the outer surface of neck 506. The inner surface 522 of spherical/cylindrical bearing 510 is shaped and sized to mate with the outer surface of the neck 506. In the embodiment shown in FIG. 11, the inner surface 522 is cylindrical, in order to conform to the cylindrical shape of the neck 506.

Spherical/cylindrical bearing 510 is slidable on neck 506. As assembled, spherical/cylindrical bearing 510 seats against a spherical inner surface 516 in the frame 502. With this arrangement, the spherical/cylindrical bearing 510 is captured within frame 502 by retainer 520, but has a certain freedom of orientation within frame 502. Similarly, neck 506 has a certain degree of freedom of movement in axial displacement within spherical/cylindrical bearing 510, with such axial displacement being bounded on the one end by shoulder 526 and at the other end by retaining plate 528.

Depending on the specific application, retaining plate 528 may be secured to neck 506 by a variety of structures, including a threaded connection, a snap fit, a press fit or any other method known to those of skill in the art. In the embodiment shown in FIG. 11, retaining plate 528 is secured to neck 506 by a set of threaded fasteners 530.

Those of skill in the art will appreciate that, this design allows for a substantial degree of axial translation, as well as a substantial degree of axial misalignment. In certain embodiments, assembly 500 may also incorporate one or more features similar to locating collar 220, described above, to fix the rotational location of the cylinder 504 while still allowing for a certain degree of misalignment.

While this invention has been described in reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A fluid containment cylinder mount comprising:

a rigid frame for supporting a neck of a fluid containment cylinder, the frame having a top surface, a front surface, a back surface, a neck receiving bore passing through the frame from the front surface to the back surface having a principal axis, and at least one fastener bore passing through the frame from the top surface to the neck bore;

a fastener, disposed at least partly within the fastener bore, having a neck securement end and at least one tensionable end, the neck securement end having an inner profile having a portion adapted to be shaped to mate with at least a portion of the neck of the fluid containment cylinder; and a tensioner, engaged to at least one tensionable end of the fastener.

2. The mount of claim 1, wherein the fastener bore is disposed substantially orthogonally to the axis of the neck bore.

3. The mount of claim 1, wherein the neck bore is substantially cylindrical.

4. The mount of claim 1, wherein the axis of the neck bore is disposed orthogonally to one or more of the front surface and the back surface.

5. A fluid containment cylinder mount comprising:

a frame having a top surface, a front surface, a back surface, a neck receiving bore passing through the frame from the front surface to the back surface having a principal axis, and at least one fastener bore passing through the frame from the top surface to the neck bore;

a fastener, disposed at least partly within the fastener bore, having a neck securement end and at least one tensionable end, the neck securement end having an inner profile having a portion adapted to be shaped to mate with at least a portion of a neck of a fluid containment cylinder, wherein the fastener is a u-bolt; and a tensioner, engaged to at least one tensionable end of the fastener.

6. The mount of claim 5, wherein the tensionable has a thread disposed thereon.

7. The mount of claim 6, wherein the tensioner is a nut.

8. The mount of claim 5, wherein the fastener bore is disposed substantially orthogonally to the axis of the neck bore.

9. The mount of claim 5, wherein the neck bore is substantially cylindrical.

10. The mount of claim 5, wherein the axis of the neck bore is disposed orthogonally to one or more of the front surface and the back surface.

11. A fluid containment cylinder mount comprising:

a frame having a top surface, a bottom surface, a front surface, a back surface, a neck receiving bore passing through the frame from the front surface to the back surface, a first fastener bore passing through the frame from the bottom surface to the top surface along a first side of the neck receiving bore, and a second fastener bore passing through the frame from the bottom surface to the top surface along a second side of the neck receiving bore opposite the first side;

a u-bolt, having a neck receiving end and first and second threaded uprights, each threaded upright disposed within one of the first and second fastener bores, the neck receiving end having a radius adapted to be sized to capture a neck of a compressed gas cylinder;

a first nut, threadably engaged to the first threaded upright; and a second nut, threadably engaged to the second threaded upright.

12. The mount of claim 11, wherein the first fastener bore is disposed substantially orthogonally to the axis of the neck bore.

13. The mount of claim 11, wherein the neck bore is substantially cylindrical.

14. The mount of claim 11, wherein the axis of the neck bore is disposed orthogonally to one or more of the front surface and the back surface.

15. A compressed gas cylinder mount comprising:

a frame having a top surface, a front surface, a back surface, a neck receiving bore passing through the frame from the front surface to the back surface, and a fastener bore passing through the frame from the top surface to the neck bore;

a fastener, disposed within the fastener bore, having a neck receiving end and a tensionable end, the neck receiving end having an inner profile suitable for capturing the neck of a compressed gas cylinder;

a tensioner, engaged to the tensionable end of the fastener;

a locating collar, disposed on the front surface of the frame around the neck receiving bore, having a first locator receiving feature and a second locator receiving feature;

a first locator, disposed in the front surface of the frame, mated to the first locator receiving feature; and a second locator, disposed in the second locator receiving feature, and adapted to be shaped to mate with a locating feature on a compressed gas cylinder neck.

16. The mount of claim 15, wherein the fastener is a u-bolt.

17. The mount of claim 16, wherein the tensionable end has a thread disposed thereon.

18. The mount of claim 17, wherein the tensioner is a nut.

19. The mount of claim 15, wherein the fastener bore is disposed substantially orthogonally to the axis of the neck bore.

20. The mount of claim 15, wherein the neck bore is substantially cylindrical.

21. The mount of claim 15, wherein the axis of the neck bore is disposed orthogonally to one or more of the front surface and the back surface.

* * * * *